United States Patent [19]

Porter

[11] 4,448,140

[45] May 15, 1984

[54] RECESSED TOP FEED FOR SEWING MACHINES

[76] Inventor: Robert E. Porter, 18 Tally Ho Dr., Hamilton, Mass. 01936

[21] Appl. No.: 432,810

[22] Filed: Oct. 5, 1982

[51] Int. Cl.[3] ..... D05B 27/04

[52] U.S. Cl. ..... 112/311; 112/320

[58] Field of Search ..... 112/320, 312, 313, 311

[56] References Cited

U.S. PATENT DOCUMENTS

| | | | |
|---|---|---|---|
| Re. 24,005 | 5/1955 | Knaus et al. . | |
| 1,006,827 | 10/1911 | Chauvet et al. . | |
| 1,243,160 | 10/1917 | Grieb . | |
| 2,549,057 | 4/1951 | Chinnici . | |
| 2,967,498 | 5/1958 | Russell et al. . | |
| 3,530,809 | 9/1970 | Porter . | |
| 3,636,899 | 1/1972 | Crisler . | |
| 3,995,571 | 12/1976 | Porter . | |
| 4,166,422 | 9/1979 | Porter | 112/311 |
| 4,285,294 | 8/1981 | Aida | 112/311 |

*Primary Examiner*—Werner H. Schroeder
*Assistant Examiner*—Andrew M. Falik
*Attorney, Agent, or Firm*—Kenway & Jenney

[57] ABSTRACT

A top feed arrangement for cooperation with a lower feed dog of a sewing machine, the lower feed dog cyclically engaging and disengaging the lower surface of material to be sewn in order to move that lower surface along a predetermined path through and past the sewing machine. The top feed arrangement comprises an upper feed dog carried by an arm that is linked to an oscillatory take-off from the primary drive system of the sewing machine. The arm is connected to the device at one end in a pivotal connection and the upper feed dog is carried at the other end of the arm. The arm is resiliently urged in a direction to cause the upper feed dog normally to approach the lower feed dog. A lifter device also responsive to the primary drive system of the sewing machine, periodically moves the upper feed dog in a direction away from the lower feed dog against the resilient force. The linkage from the sewing machine drive to the top feed is housed in a recessed area removed from the work and an uncluttered large work area is provided.

3 Claims, 3 Drawing Figures

RECESSED TOP FEED FOR SEWING MACHINES

BACKGROUND OF THE INVENTION

The present invention relates in general to top feeders for sewing machines and in particular to a simplified arrangement linking a top feeder to the primary sewing machine drive.

For many years, sewing machines have been provided with a lower feed mechanism, usually located formed through an opening in the work surface of the machine adjacent the stroke of the sewing machine needle and operating to engage the undersurface of materials being sewn and periodically to advance the material to, and past, the needle. Because such a feeding arrangement acts positively only on the lowermost surface of the plural layers of material being sewn, it has long been desired to provide in a sewing machine an arrangement which would achieve a positive feed of the upper layer of material in addition to the conventional positive feed of the lower layer of material. Such an arrangement was recognized as being badly needed in so-called overedgers and safety-stitch sewing machines.

Various approaches have been attempted, such as rotary feed wheels driven through flexible cables and bearing upon the top surface of materials being sewn. Yet, success was minimal until the introduction of a "top feeder" that operated in synchronism with the conventional lower work feeder to provide for a positive feeding of the entire "sandwich" of material being sewn. This previous "top feeder" is the subject of U.S. Pat. No. 3,530,809, issued Sept. 29, 1970 to Robert E. Porter, the disclosure of which is incorporated herein by reference.

While the feeding arrangement described and claimed in U.S. Pat. No. 3,530,809 has enjoyed substantial success, it has become apparent that various improvements over the feeding arrangement shown in that patent can yield substantially improved performance: e.g., less wear, smoother and quieter operation, simplicity of repair and interchange of parts, more positive gripping of the material being sewn, etc. Two such improvements are disclosed in U.S. Pat. No. 3,995,571 issued Dec. 7, 1976 and U.S. Pat. No. 4,166,422 issued Sept. 4, 1979 to Robert E. Porter, the disclosure of both of these patents also being incorporated herein by reference.

In most of the improved top feed arrangements, there has been an accumulation of linkage and other mechanism which can interfere with ease of operation and reduce available working area.

Accordingly, the primary object of the present invention is a top feed arrangement for a sewing machine which not only has improved performance in one or more of the areas mentioned above but which also is of vastly simplified design and provides a large uncluttered work area.

SUMMARY OF THE INVENTION

Generally, in the present invention improvements are provided in a sewing machine having one or more stitching needles, a lower feed dog arrangement for engaging and disengaging the lower surface of the material or materials being sewn to move that lower surface along a predetermined path, an upper feed dog carried by an arm that is linked to the primary drive means of the sewing machine providing synchronized movement of the lower and upper feed dogs. The linkage for horizontal motion is accomplished in an area which lies beneath the work area and which does not interfere with ease of operation. The lifter means for vertical motion of the upper feed dog is responsive to the sewing machine's primary drive system for periodically moving the upper feed dog in a direction away from the lower feed dog against the force of a biasing means. This vertical motion conversion is also well away from the work area. According to the present invention, it has been found that this arrangement results not only in a simpler, cleaner work surface but also suffers no loss of gripping and feeding forces.

For a better understanding of the present invention together with other objects, features and advantages, reference should be made to the following specification which should be read in conjunction with the appended drawings.

DESCRIPTION OF PREFERRED EMBODIMENT

Figure 1:
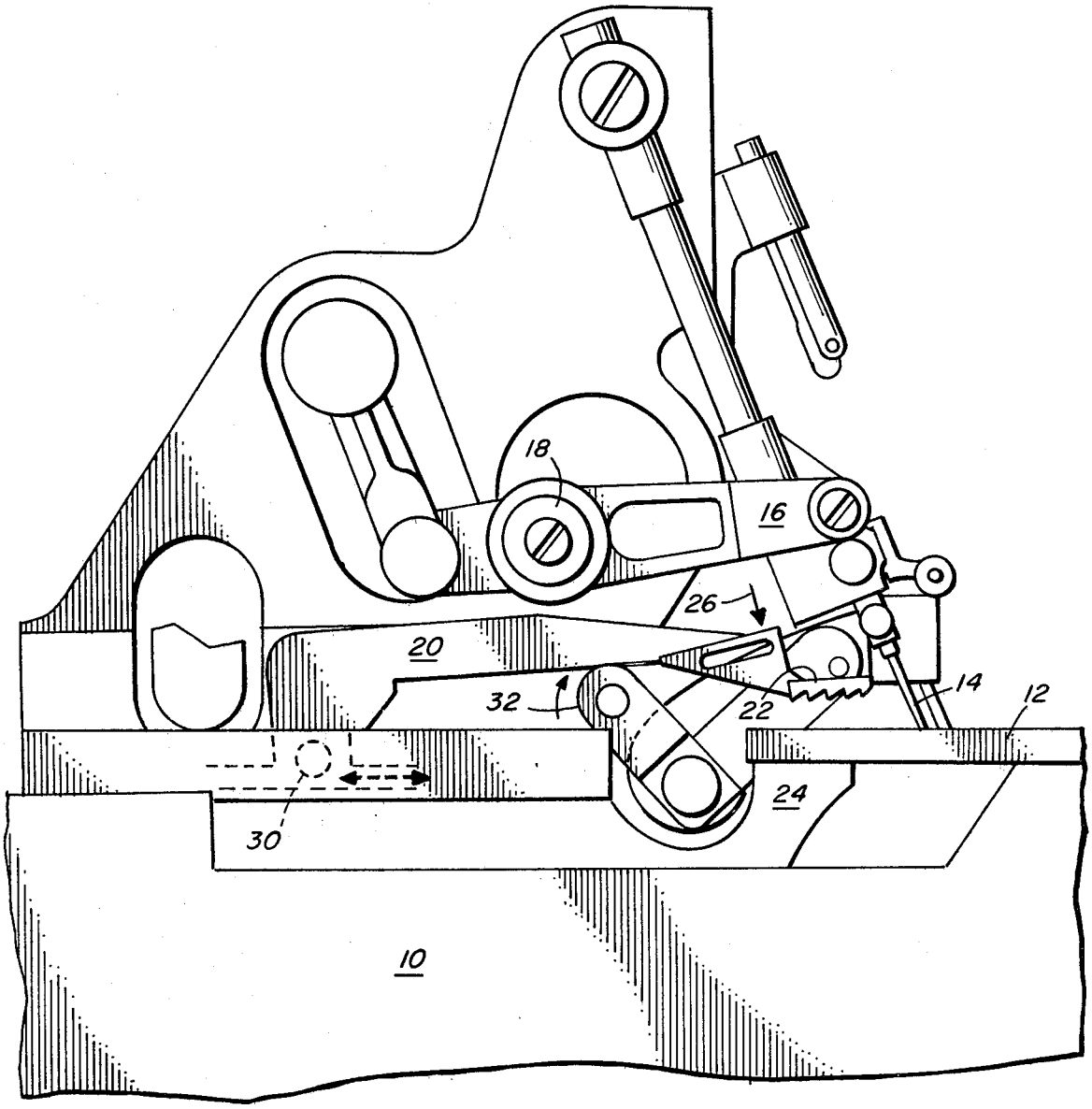
FIG. 1 is a side view of a sewing machine with certain parts removed and others shown fragmentarily in order to illustrate better the top feed mechanism in its non-feeding position.

In FIG. 1 there may be seen the bed or frame of a sewing machine 10 on which a needle plate 12 is mounted, the needle plate typically having an opening for a needle or needles 14 to penetrate during the stitching strokes. Drive for the needles and other elements such as the knife arm is provided from a crank arm 16 driven reciprocally by a drive mechanism 18 which is connected to the primary drive system of the sewing machine. Such drive systems are conventional and are well known. A typical example is found in the Rimoldi catalog No. N. 239 issued by Rockwell-Rimoldi S.p.A. of Milan, Italy. The disclosure of that catalog is incorporated herein by reference for its disclosure of a suitable machine with which the top feed of this invention may be combined.

A top feed arm 20 carrying a top feed dog 22 is mounted for top feeding action relative to the needle plate 12. It is shown with the top feed dog 22 raised above the needle plate 12. Juxtaposed with relation to the top feed dog is a lower feed dog 24 which has a serrated upper surface not visible in this view. The serrated upper surface of the lower feed dog 24 operates in conjunction with the serrated lower surface of the top feed dog 22 to grip and feed material being sewn in much the same manner as the top feeds disclosed in the patents mentioned above.

Resilient force is normally exerted on the top surface of the top feed arm 20 by any suitable device as indicated by the arrow 26. The conventional cylinder, compression spring and adjustable mechanism for providing such resilient force are not shown in detail in this view. The top feed arm 20 is pivoted at its back end from a movable point 30 as explained in greater detail hereinafter.

In this showing, the top feed arm, as noted, is in a non-feeding position raised from the throat or needle plate 12 and the lower feed dog 24, which may be a feed dog of the type shown in the catalog cited above, is lowered beneath the surface of the throat plate 12. At this point, as may be seen, the needles 14 are at or about the limit of their downward stitching stroke.

Figure 2:
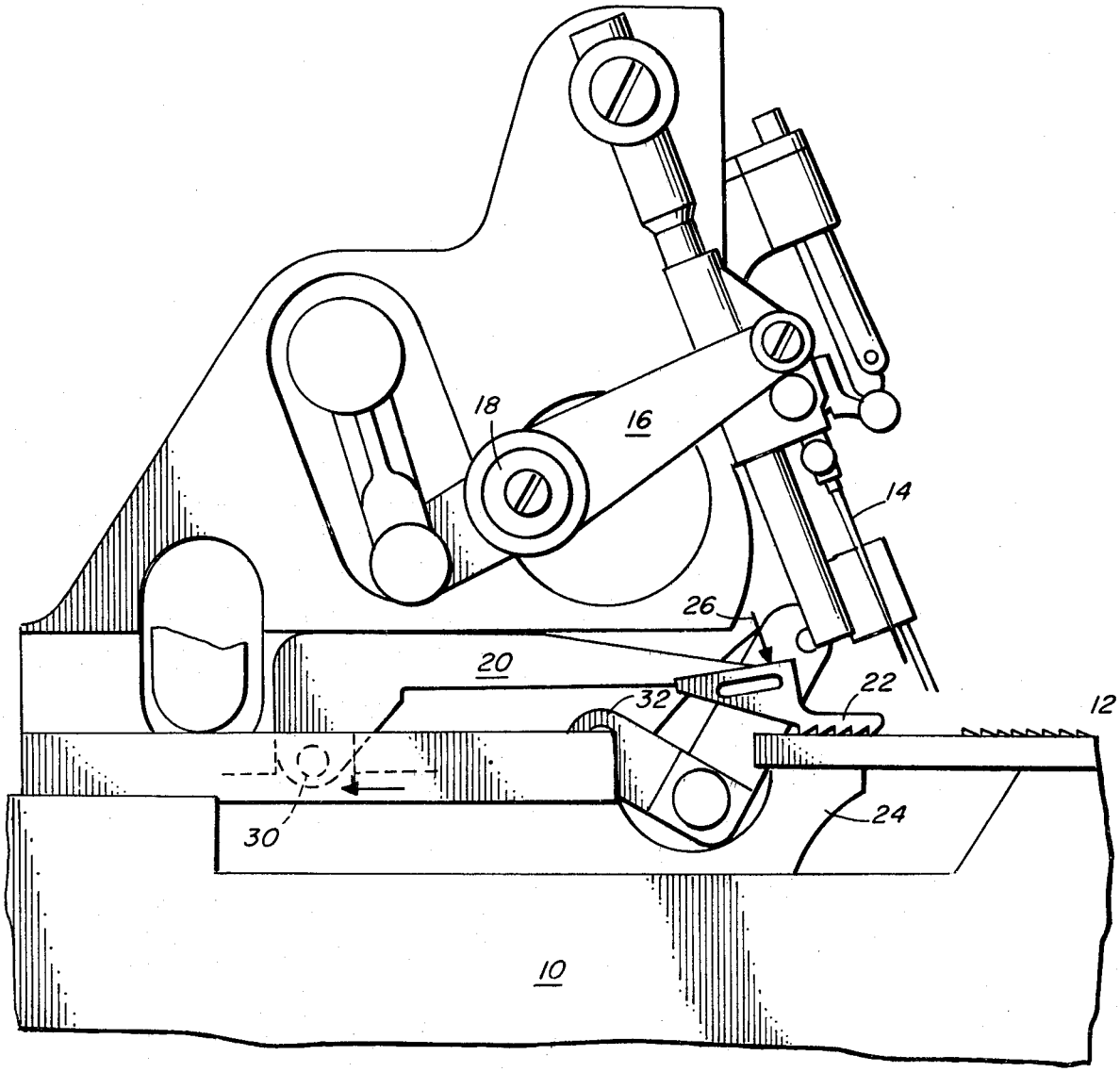
FIG. 2 is a second side view similar to FIG. 1 but showing the top feed in its feeding position.

In FIG. 2, it will be noted that the top feed dog 22 is down and in a feeding position to contact the top layer of material being sewn while the lower feed dog 24 is raised to a position where it would be in contact with the lower surface of the material being sewn. No material is actually shown for purposes of simplification of the drawing. The needles 14 are withdrawn from the throat plate 12 and are well above the material. At this time, material, if it were present, would be feeding from right to left as shown in the drawing. Only after the conclusion of the feeding motion does the downward stroke of the needles take place. Vertical motion of the top feed arm 20 is provided by a roller cam 32 which contacts the lower surface of the top feed arm periodically. As the roller cam contacts that lower surface, it lifts the top feed arm against the resilient downward pressure from the member providing the downward resilient urging force 26. In FIG. 2, it will be noted that the force 26 is urging the top feed arm 20 down, causing the top feed dog 22 to be in its operative feeding position. The roller cam 32 is at this point in the cycle completely out of contact with the lower surface of the top feed arm 20.

Figure 3:
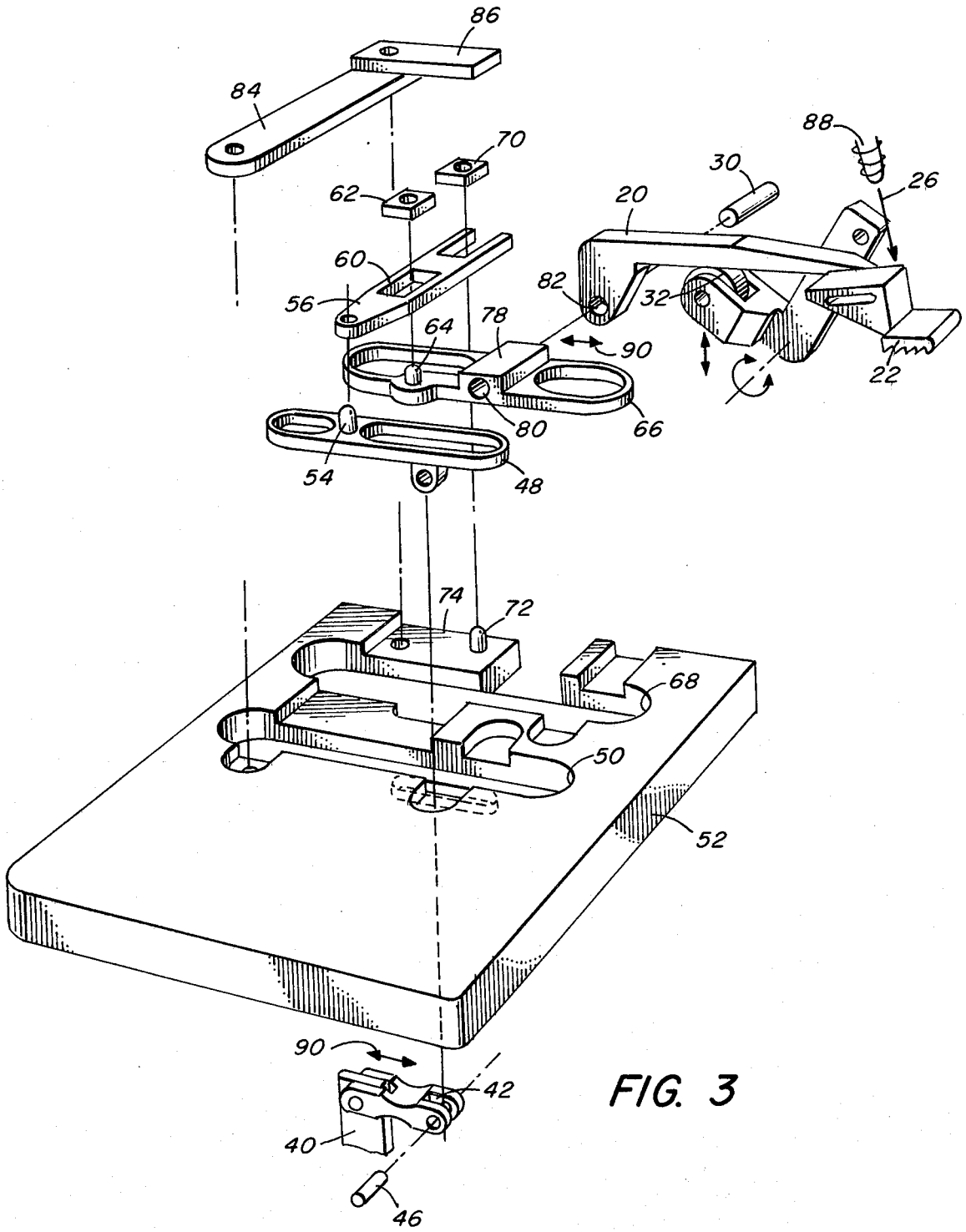
FIG. 3 is an exploded view showing a preferred method of driving the top feed mechanism.

FIG. 3 illustrates the simplified drive system of the top feed of the present invention. For purposes of simplicity, the drive mechanism is shown in an inverted position. That is, the components are shown as assembled in the top surface of a bed plate. Actually, the drive components are preferably mounted on the underside of the bed plate to leave a smooth top surface.

Power take-off for the top feed motion may be had at several points in the sewing machine primary drive system. In the present case, however, power is taken from the oscillating differential bottom feed arm 40 to which a link 42 is attached. A pin 46 connects the end of the link 42 to a primary slide block 48, which is fitted in an opening 50 in the surface of the bed plate 52. The opening 50 is, of course, long enough to permit the primary slide block 48 to slide to and fro. An upright pin 54 connects the primary slide block 48 to a secondary drive link 56. The secondary drive link 56 has a tapered end which facilitates its movement with the movement of the primary slide block 48. A generally rectangular opening 60 is formed approximately midway in the secondary drive link 56. It accommodates a generally rectangular pivot block 62 which is fitted over an upright pin 64 formed on a secondary slide block 66. The secondary slide block 66 is disposed for reciprocation in an opening 68 formed in the top surface of the bed plate 52. The far end of the secondary drive link 56 has a generally rectangular open-ended area which accommodates a top feed pivot block 70. The pivot block 70 is mounted upon an upright pin 72 which extends upwardly from a shoulder 74 on the top surface of the bed plate 52.

A generally rectangular platform 78 is formed on the top surface of the secondary slide block 66. An opening 80 is drilled through the length of the platform 78 and a matching opening 82 is drilled through the end of the top feed arm 20. The pin 30 passes through the openings 80 and 82 to connect the member 78 with the end of the top feed arm 20. Cover members 84 and 86 are designed to be fitted to the top of the bed plate 52 with similar members not shown to hold the mechanism in place. Finally, the source of resilient force 26 is shown schematically at 88.

In operation, the oscillating motion of the differential feed arm 40 is translated by the slide blocks and the slide links into a horizontal motion of the top feed arm 20, as indicated by the arrows 90. The link 42 causes the primary slide 48 to slide in its opening thus moving the tapered end of the secondary link 56 in similar fashion about an axis at the pin 72 which is fixed in the plate 52. About midway along the link 56, the pivot block 62 moving while sliding in its opening 60 transfers motion to the secondary slide 66 which is pivotally connected to the top feed arm 20.

Vertical motion of the top feed arm 20 is provided by the cam roller 32 as previously noted. The vertical motion can be obtained from any number of points in the sewing machine drive, but is shown best in FIG. 1 as being derived from the knife arm motion.

As the top feed rises as shown in FIG. 1, the cam roller 32 is in contact with the lower surface of the top feed arm 20, and the slide elements in the bed plate 52 are commencing their motion from left to right as shown. Conversely, with the cam roller 32 out of contact with the top feed arm 20, the resilient force from the element 88 is maintaining the top feed arm at its furthest downward position. The elements of the slide mechanism in the bed plate 52 are commencing their motion from right to left as shown.

What is claimed is:

1. In a sewing machine having a source of drive, a top feed for material to be sewn and a work area over which said material passes, a horizontal drive system for said top feed which comprises a bed plate disposed beneath said work area, and having openings formed in a surface thereof, slide members disposed in said openings, means connecting said slide members to said source of power to cause reciprocation thereof in said openings and means connecting said slide members to said top feed to apply material feeding motion thereto.

2. In a sewing machine as defined in claim 1, the combination in which said slide members comprise two substantially flat members reciprocating along parallel lines, the first of said members being pivotally connected to said source of power, the second of said members being pivotally connected to said top feed, and a link connecting said flat members together.

3. In a sewing machine as defined in claim 2, the combination which further includes a roller cam for lifting said top feed arm periodically in predetermined synchronism with said slide members.

* * * * *